United States Patent [19]

Mitchell

[11] Patent Number: 5,064,077

[45] Date of Patent: Nov. 12, 1991

[54] DISPLAY TREE APPARATUS

[76] Inventor: Bobby R. Mitchell, 5711 Tawney, Amarillo, Tex. 79106

[21] Appl. No.: 694,771

[22] Filed: May 2, 1991

[51] Int. Cl.[5] ..... A47F 7/00

[52] U.S. Cl. ..... 211/60.1; 211/13

[58] Field of Search ..... 211/13, 60.1, 70, 69.5, 211/71, 163, 205

[56] References Cited

U.S. PATENT DOCUMENTS

| | | | |
|---|---|---|---|
| D. 37,094 | 8/1904 | Otto | 211/69.5 X |
| 846,133 | 3/1907 | McIntyre | 211/70 X |
| 2,000,359 | 5/1935 | Stein | 211/13 X |
| 2,637,299 | 5/1953 | Salkey | 211/69.5 X |
| 3,431,041 | 3/1969 | Fontlladosa | 211/60.1 X |
| 3,984,004 | 10/1976 | Devanney | 211/71 |
| 3,987,903 | 10/1976 | Swilley | 211/13 |
| 4,040,520 | 8/1977 | Joaquin | 211/13 |

*Primary Examiner*—Robert W. Gibson, Jr.
*Attorney, Agent, or Firm*—Leon Gilden

[57] ABSTRACT

The present invention provides a support including a central cylindrical body spaced from an upper base and a lower base, each by a gap to provide manual access to a central axial positioned support axle for ease of transport and manipulation of the organization. The central cylindrical body includes an inner cylindrical body, each body including an axially aligned bore for receiving a rod therewithin. A modification of the invention includes a translucent outer cylindrical body, with an illumination member positioned between adjacent outer bores, wherein inner bores of the inner cylindrical body include a pressure-sensitive micro-switch positioned interiorly of the body adjacent the inner bore, whereupon removal of a rod, such as a pencil or lollipop structure from the inner and outer bores closes a circuit to effect actuation of an audible unit.

4 Claims, 4 Drawing Sheets

DISPLAY TREE APPARATUS

BACKGROUND OF THE INVENTION

1. Field of the Invention

The field of invention relates to support structure, and more particularly pertains to a new and improved display tree apparatus wherein the same is arranged for novel support and dispensing of various rod-like articles therefrom.

2. Description of the Prior Art

Various support and display apparatus have been utilized in the prior art to aid in the dispensing and mounting of various components for ease of access and reliability of construction in the support and mounting of various rod-like components. Such apparatus may be found for example in U.S. Pat. No. 4,397,395 to McKelvey wherein a support base mounts a plurality of rod-like drill bits therewithin.

U.S. Pat. No. 4,136,773 to Booth sets forth a container, including a plurality of vertically aligned bores for receiving crayons therewithin for the mounting and support of the crayons.

U.S. Pat. No. 3,727,771 to Hoffman sets forth a drill supporting mount, wherein a series of coaxially positioned bores are positioned within a single base for mounting of drill bits therewithin.

U.S. Pat. No. 4,519,498 to Booth sets forth a container for mounting in a stable relationship in a matrix of crayons in a vertical orientation relative to one another.

U.S. Pat. No. 4,030,599 to Bruni sets forth a drill bit holder for mounting drill bits in vertical spaced bores.

As such, it may be appreciated that there continues to be a need for a new and improved display tree apparatus as set forth by the instant invention which addresses both the problems of ease of use as well as effectiveness in construction in providing a display and support organization and in this respect, the present invention substantially fulfills this need.

SUMMARY OF THE INVENTION

In view of the foregoing disadvantages inherent in the known types of support apparatus now present in the prior art, the present invention provides a display tree apparatus wherein the same is arranged for mounting in an angulated annular array a matrix of rod-like members and further utilizing audible means to annunciate removal of each of the members. As such, the general purpose of the present invention, which will be described subsequently in greater detail, is to provide a new and improved display tree apparatus which has all the advantages of the prior art display apparatus and none of the disadvantages.

To attain this, the present invention provides a support including a central cylindrical body spaced from an upper base and a lower base, each by a gap to provide manual access to a central axially positioned support axle for ease of transport and manipulation of the organization. The central cylindrical body includes an inner cylindrical body, each body including an axially aligned bore for receiving a rod therewithin. A modification of the invention includes a translucent outer cylindrical body, with an illumination member positioned between adjacent outer bores, wherein inner bores of the inner cylindrical body include a pressure-sensitive microswitch positioned interiorly of the body adjacent the inner bore, whereupon removal of a rod, such as a pencil or lollipop structure from the inner and outer bores closes a circuit to effect actuation of an audible unit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved display tree apparatus which has all the advantages of the prior art display apparatus and none of the disadvantages.

It is another object of the present invention to provide a new and improved display tree apparatus which may be easily and efficiently manufactured and marketed.

It is a further object of the present invention to provide a new and improved display tree apparatus which is of a durable and reliable construction.

An even further object of the present invention is to provide a new and improved display tree apparatus which is susceptible of a low cost of manufacture with regard to both materials and labor, and which accordingly is then susceptible of low prices of sale to the consuming public, thereby making such display tree apparatus economically available to the buying public.

Still yet another object of the present invention is to provide a new and improved display tree apparatus which provides in the apparatuses and methods of the prior art some of the advantages thereof, while simultaneously overcoming some of the disadvantages normally associated therewith.

Still another object of the present invention is to provide a new and improved display tree apparatus wherein the same is arranged to mount and audibly annunciate various rod-like components therewithin, such as pencils, lollipops, and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
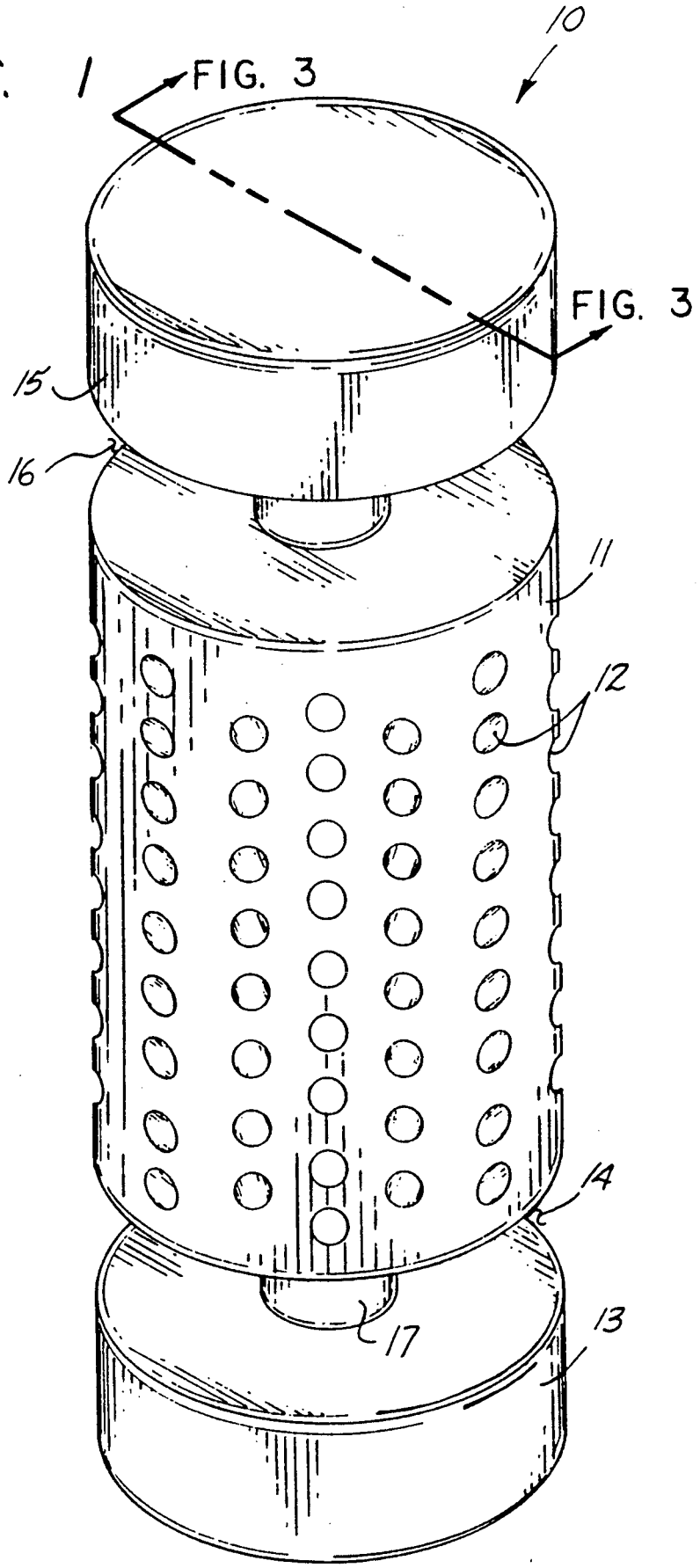
FIG. 1 is an isometric illustration of the instant invention.
Figure 3:
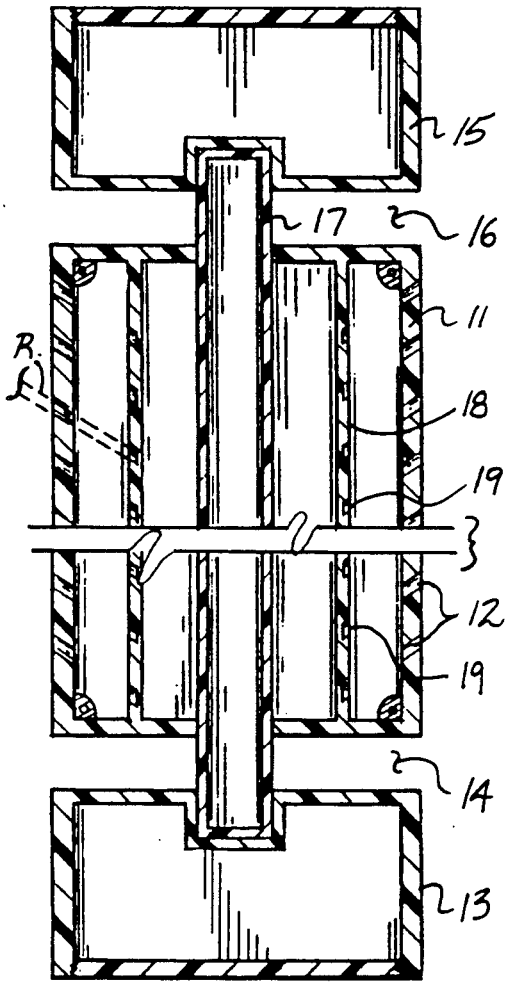
FIG. 3 is an orthographic view, taken along the lines 3—3 of FIG. 1 in the direction indicated by the arrows.
Figure 2:
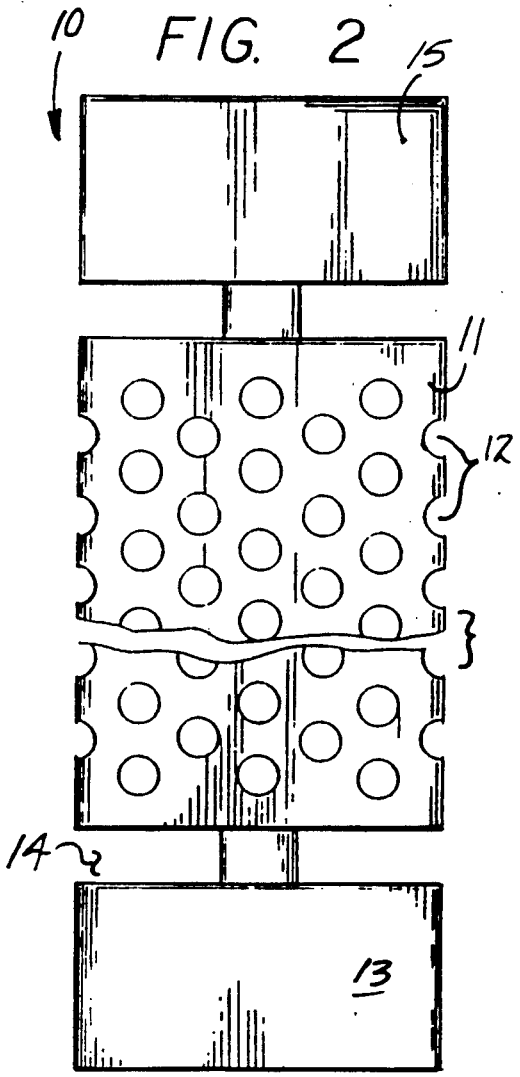
FIG. 2 is an orthographic side view of the instant invention.
Figure 4:
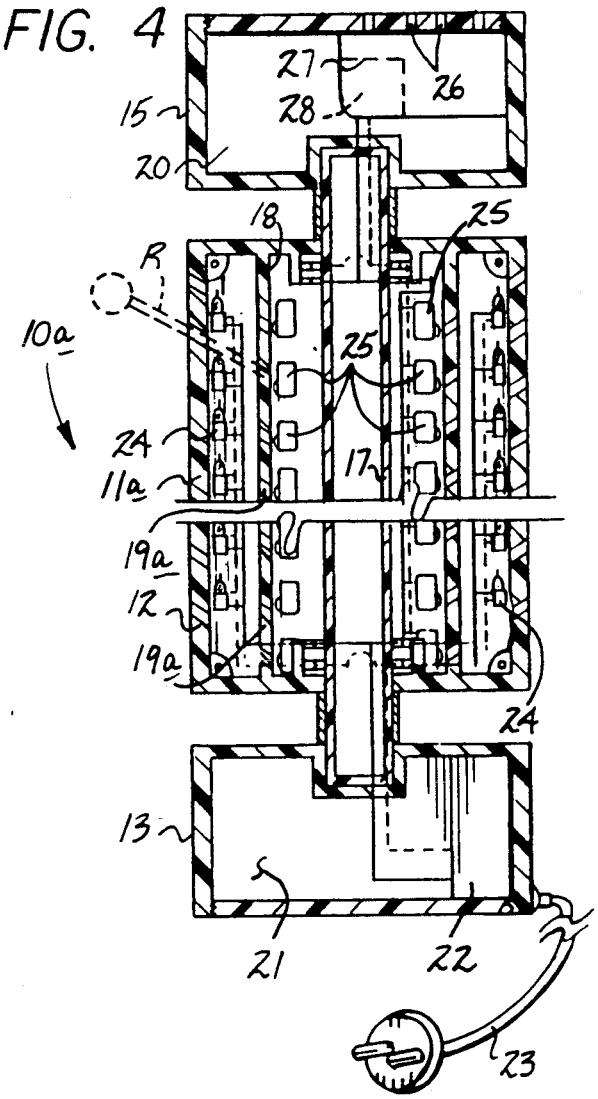
FIG. 4 is an orthographic cross-sectional illustration of a modification of the instant invention.
Figure 5:
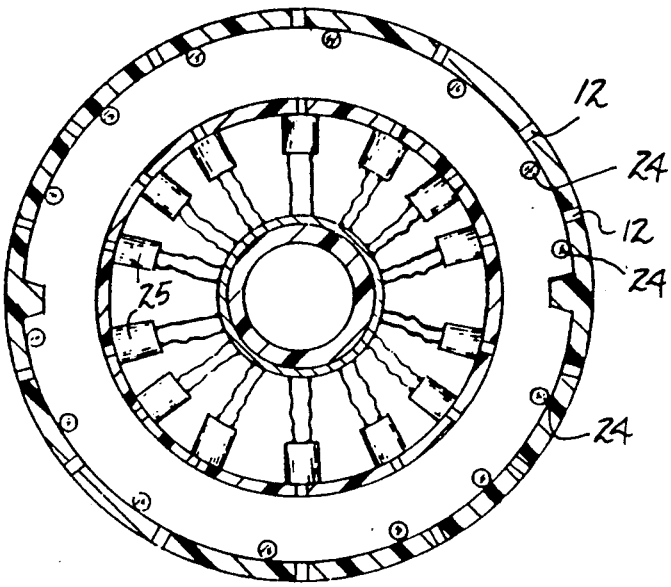
FIG. 5 is an orthographic top sectional view of the instant invention.
Figure 6:
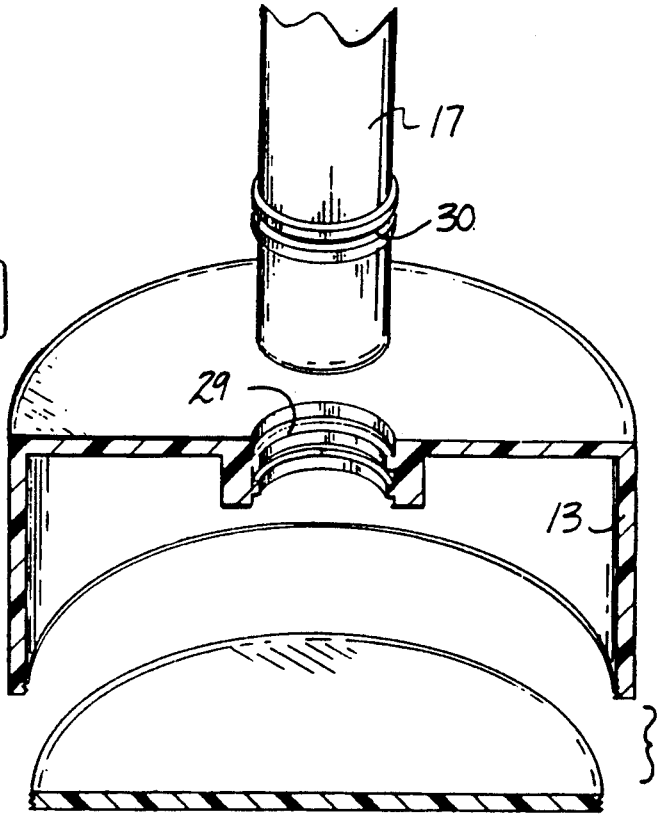
FIG. 6 is an isometric, exploded illustration of the base structure of the instant invention.
Figure 7:
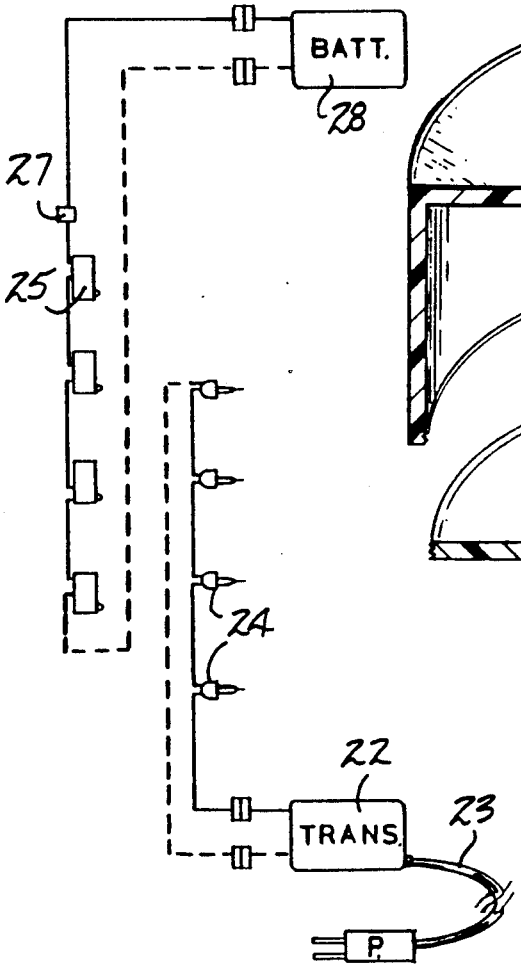
FIG. 7 is a diagrammatic illustration of the circuitry utilized by the instant invention.

With reference now to the drawings, and in particular to FIGS. 1 to 7 thereof, a new and improved display tree apparatus embodying the principles and concepts of the present invention and generally designated by the reference numerals 10 and 10*a* will be described.

More specifically, the display tree apparatus 10 of the instant invention essentially comprises a cylindrical central outer body 11, including a matrix of first bores 12 directed therethrough. The central outer body 11 includes a coaxially positioned support axle 17 directed therethrough mounting a lower support base 13 below the central outer body 11 spaced by a lower cylindrical gap 14. An upper base 15 is spaced from the central outer body 11 by an upper cylindrical gap 16. The lower and upper cylindrical gaps 14 and 16 respectively provide manual access to the apparatus for ease of grasping the support axle 17 within the gaps for ease of transport and manipulation of the organization. A cylindrical central inner body 18 is positioned within the outer body 11 coextensively therewith and coaxially aligned relative to the outer body. The cylindrical central body 18 includes a matrix of cylindrical cavities 19, with each cylindrical cavity aligned with a respective first bore of the matrix first bores 12 to receive a rod "R" (see FIG. 3) within the first bores 12 and the cylindrical cavities 19.

FIGS. 4–7 illustrate the use of a modified apparatus 10*a*, wherein the upper base 15 includes an upper cavity 20, and the lower base 13 includes a lower base cavity 21. A transformer 22 is mounted within a lower base cavity, with an alternating current power cord 23 directed to the transformer 22 to direct electrical energy to a matrix of illumination bulbs 24 mounted to an interior surface of a modified translucent cylindrical central outer body 11*a*. Each illumination bulb 24 is spaced between a plurality of the first bores 12 to provide illumination of the outer body 11*a*, wherein each associated workpiece or rod "R" is more highly visible by contrast with the translucent outer body. The cylindrical inner body 18 includes through-extending second bores 19*a*, with each bore 19*a* aligned with a respective first bore 12 to receive the rod "R" through each pair of bores defined by a first bore 12 and a second bore 19*a*. Positioned within the cylindrical inner body 18 is a pressure-sensitive micro-switch 25, with the pressure-sensitive micro-switch 25 positioned interiorly of and adjacent each second bore 19*a*. Each micro-switch 25 is normally in an open positioned when pressurized by a rear terminal end of the rod "R". Upon removal of the rod "R", the micro-switch 25 is closed to a second position to effect actuation of a speaker within a speaker housing 27 that is electrically communicated through a battery 28 mounted therewithin. A speaker grill 26 is directed through a top surface of the upper base 15, thus audible annunciation of removal of a rod "R" from a respective bore pair is announced and typically associated with a message such as "Thank you", "Have a nice day", and the like.

If desired, the upper and lower terminal ends of the axle 17 may be inner fitted within the upper and lower base members 13 and 15, wherein each base member may include a ribbed annular support opening 29 receiving an annular flange 30 of the axle 17 to permit disassembly of the organization.

It should be noted that each pair of bores defined by a bore 19*a* and a bore 12 is inclined at acute included angles defined by an axis of the support axle 17, and each pair of bores defined by a bore 12 and a bore 19 to mount each rod "R" in a readily accessible and mounted configuration within the vertically oriented central outer body 11 and the central inner body 18.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A display tree apparatus, comprising in combination, a cylindrical central outer body, the cylindrical central body including a coaxially directed support axle directed coaxially of the cylindrical central body and extending exteriorly of the central outer body, and an upper base mounted to an upper terminal end of the support axle defining an upper gap between the upper base and the central outer body, and a lower base mounted to a lower terminal end of the support axle spaced from the central outer body defining a lower gap, wherein the upper and lower gaps provide manual access to the support axle for manual manipulation of the apparatus, and the central outer body including a matrix of first bores directed therethrough, and further including a cylindrical central inner body, the cylindrical central inner body including a matrix of second bores directed therethrough, and each of said first bores is coaxially aligned with one of said second bores defining a pair of bores, and a rod-like member receivable within each of said pair of bores.

2. An apparatus as set forth in claim 1 wherein each pair of bores defines an acute included angle between each of said pair of bores and the support axle.

3. An apparatus as set forth in claim 2 wherein the central outer body is translucent, and an illumination member is mounted between the matrix of first bores and positioned adjacent an interior surface of the central outer body, and the lower base includes a transformer, the transformer includes an alternating current power supply cord, and the transformer is in electrical communication with each of the illumination members.

4. An apparatus as set forth in claim 3 wherein the upper base includes an upper base cavity, the upper base cavity including a speaker housing mounted therewithin, the speaker housing positioned adjacent a matrix of openings directed through the upper base, and the speaker housing including a speaker therewithin, and the speaker housing further including a battery, the battery in electrical communication with a matrix of normally opened micro-switch members, and each micro-switch member is positioned interiorly of the cylindrical central inner body adjacent a second bore of the said second bores, and each micro-switch member is situated to a second closed position upon removal of the respective rod, wherein each rear terminal end of each rod is normally in contiguous communication with one of said micro-switch members of the matrix of micro-switch members adapted to effect actuation of said speaker to provide an audible message upon removal of an associated rod from one of said pair of bores.

* * * * *